United States Patent [19]

Collette

[11] Patent Number: 4,611,543

[45] Date of Patent: Sep. 16, 1986

[54] RESTRICTOR APPLICATION FOR IN LINE GAS ENTRAINED SOLIDS REDISTRIBUTION

[75] Inventor: Robert J. Collette, Windsor, Conn.

[73] Assignee: Combustion Engineering, Inc., Windsor, Conn.

[21] Appl. No.: 331,697

[22] Filed: Dec. 17, 1981

[51] Int. Cl.[4] ..... F23K 3/02

[52] U.S. Cl. ..... 110/263; 138/44; 110/347; 110/106

[58] Field of Search ..... 110/260, 261, 262, 263, 110/347, 106; 138/44

[56] References Cited

U.S. PATENT DOCUMENTS

| | | | |
|---|---|---|---|
| 3,142,960 | 8/1964 | Bluck | 138/44 |
| 3,259,206 | 7/1966 | Straw | 138/44 |
| 3,326,041 | 6/1967 | Reed | 138/44 |
| 3,712,341 | 1/1973 | Constantin et al. | 138/44 |
| 3,934,522 | 1/1976 | Booker | 110/347 |
| 3,934,614 | 1/1976 | Elek et al. | 138/44 |
| 4,263,856 | 4/1981 | Rickard | 110/263 |
| 4,274,343 | 6/1981 | Kokkinos | 110/263 |
| 4,325,460 | 4/1982 | Hoppenstedt | 138/44 |

*Primary Examiner*—Henry C. Yuen

*Attorney, Agent, or Firm*—Robert L. Olson

[57] ABSTRACT

The invention comprises a burner (10), a first fuel pipe (18) for conveying a mixture of air and pulverized coal to the burner (10), a second fuel pipe (32) for conveying the mixture to the first pipe (18), an elbow (26) joining the first pipe (18) to the second pipe (32), said elbow (26) having an inner radius and an outer radius (27), the improvement comprising a restriction (30) in the second pipe (32), being located such that it forces the coal particles towards the outer radius (27) of the elbow (26), thereby reducing impact wear on the outer radius wall (27) of the elbow (26).

3 Claims, 3 Drawing Figures

RESTRICTOR APPLICATION FOR IN LINE GAS ENTRAINED SOLIDS REDISTRIBUTION

BACKGROUND OF THE INVENTION

The present invention is directed to apparatus for reducing wear in an elbow of a pipe carrying solids in a stream of gas. An example is the coal nozzle inlet elbow leading to a burner in a steam generating furnace. The larger particles of coal impacting on the elbow causes considerable wear, leading to frequent shutdowns to replace the elbow. Attempts to solve the problem include putting a ceramic liner in the elbow, or making the entire elbow of ceramic material. The cost of such an elbow is many times that of a metal elbow, and in addition the ceramic elbow or liner can be easily broken.

Another problem associated with coal fired burners is being able to fire them at low load, while maintaining stable flame conditions, without the need for costly secondary fuel, such as oil or gas. U.S. Pat. No. 4,274,343 discloses a burner capable of such operation. This patent discloses a burner having an upper outlet opening a lower outlet opening, and it relies on separation of the fuel by centrifigal force as it flows through an elbow. Thus the coal-air stream flowing to the upper outlet is dense enough to maintain a stable flame. The present invention is also an improvement on the above patent.

SUMMARY OF THE INVENTION

In accordance with the invention a restriction is placed in a pipe upstream of an elbow connected to a split burner. The pipe carries pulverized coal and air to the burner. The restriction is located on the same side of the pipe as the inner radius of the elbow, so that the heavier particles of coal move towards the outer radius of the elbow. This will reduce wear on the elbow by changing much of the large particle impact wear (high wear rate) to large particle abrasive wear. Concentrating the larger particles of coal to the outside of the elbow will reduce the angle of impact, which is critical in material removal (wear) of the elbow. On the downstream side of the burner, there will also be a much higher concentration of heavy coal particles on the side of the pipe coinciding with the outer radius of the elbow, which will aid in stable flame conditions of the burner at low load operation.

DESCRIPTION OF THE PREFERRED EMBODIMENT

Figures 1, 2, 3:
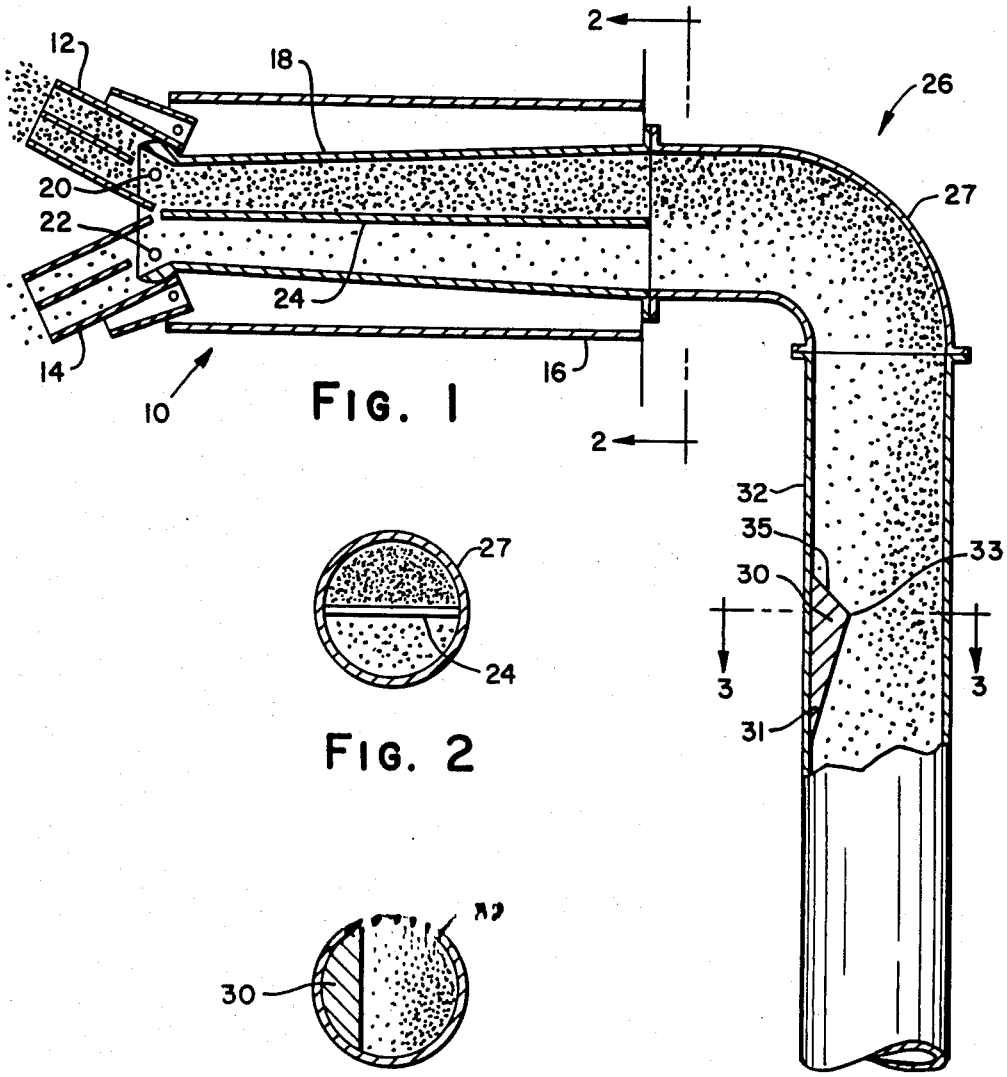
FIG. 1 is an elevational cross-sectional view of a fuel-air emission assembly of a steam generator incorporating the invention.
FIG. 2 is a view taken on line 2—2 of FIG. 1.
FIG. 3 is a view taken on line 3—3 of FIG. 1.

Looking now to FIG. 1, numeral 10 designates a fuel-air emission assembly or burner for introducing pulverized coal and air into the furnace of a steam generator for combustion therein. The burner has an upper outlet port 12 and a lower outlet port 14, through which the coal and air are introduced into the furnace. Secondary air is introduced through conduit 16. The members forming outlet or discharge ports 12 and 14 are pivotally mounted to the end of delivery pipe 18 so as to be independently tiltable about their axes 20 and 22, respectively. This permits the coal and air mixture to be selectively discharged into the furnace in parallel streams, effectively forming a single stream, or as two diverging streams by tilting one or both of the nozzles.

The coal-air mixture enters pipe 18 from inlet elbow 26. As the mixture flows through elbow 26, centrifigal force causes the more dense particles in the mixture to concentrate along the outer radius. Therefore, two distinct mixtures of differing fuel-air ratios exist downstream of the elbow 26; these being a dense mixture along the outer radius, and a lean mixture along the inner radius. In order to maintain these separate phases or mixtures at the outlet ports or nozzles, a partition plate 24 (FIGS. 1 and 2) is disposed along the longitudinal axis of the pipe 18. Thus, when the burner is being fired at low load conditions, the mixture flowing to upper nozzle 12 is fairly dense, and a stable flame can be maintained, even at low load operation. This flame thus maintains ignition and combustion of the rather lean mixture issuing from nozzle or port 14. The above is disclosed in U.S. Pat. No. 4,273,343.

In accordance with the present invention, a restriction 30 (FIGS. 2 and 3) is located upstream of the elbow along the inner radius side of pipe 32. This forces the solids over against the outer radius wall of pipe 32 upstream of the elbow 26. This results in two distinct advantages. First, with the majority of the heavier coal particles approaching the elbow 26 adjacent the outer radius 27, wear on the elbow is substantially reduced. Instead of impact wear, there is abrasive wear along the outer radius 27 of the elbow. The abrasive wear is considerably less than the impact wear would be. Concentrating the larger particles to the outside of the elbow reduces the angle of impact, greatly reduces the impact wear.

The second advantage achieved is that the restriction 30 results in a greater separation of the two mixtures leaving the elbow, thus aiding the turn-down ratio of the burner 10.

Any type restriction 30 located on the inner radius of pipe 32 upstream of elbow 26 will result in the above two advantages. It is desirable to use a restriction having a smooth incline both in the approach 31 to its highest point 33, and in its discharge 35. This reduces pressure drop there across, and also turbulent flow, which would detract from the desired separation.

I claim:

1. In combination a burner, a first substantially horizontal fuel pipe for conveying a mixture of air and pulverized coal to the burner, a second substantially vertical fuel pipe for conveying the mixture to the first pipe, an elbow joining the first pipe to the second pipe, said elbow having an inner radius and an outer radius, the improvement comprising a restriction in the second pipe, being located such that it forces the coal particles towards the outer radius of the elbow, thereby reducing impact wear on the outer radius wall of the elbow, and a substantially horizontal plate means separating the first pipe along its longitudinal axis, so as to form a first upper passage, and a second lower passage, so that a high density stream flows through the upper passage, and a low density stream flows through the lower passage.

2. The combination set forth in claim 1, wherein the burner has two outlet nozzles, one being substantially in alignment with the outer radius of the elbow, and the other being substantially in alignment with the inner radius of the elbow.

3. The combination set forth in claim 2, wherein the restriction has a smooth leading up to a zenith, and a smooth decline leading away from said zenith, so as to reduce pressure drop and turbulent flow.

* * * * *